US006037854A

United States Patent [19]

Baker et al.

[11] Patent Number: 6,037,854

[45] Date of Patent: Mar. 14, 2000

[54] THERMAL FUSE FOR FLUORESCENT LAMPS

[75] Inventors: Jonathan T. Baker, Mattituck; Glenn T. Schmidt, Selden, both of N.Y.

[73] Assignee: Aerospace Lighting Corporation, Holbrook, N.Y.

[21] Appl. No.: 09/071,562

[22] Filed: May 1, 1998

[51] Int. Cl.[7] ..... H01H 85/00; H01H 61/04; H01H 37/32; H05B 37/03

[52] U.S. Cl. ..... 337/405; 337/401; 337/404; 337/22; 315/362; 315/73; 315/74

[58] Field of Search ..... 337/4, 22, 23, 337/24, 25, 26, 27, 166, 185, 232, 296, 297, 401–407; 315/362, 73, 74

[56] References Cited

U.S. PATENT DOCUMENTS

| | | | |
|---|---|---|---|
| 3,737,717 | 6/1973 | Arendash | 315/75 |
| 3,767,965 | 10/1973 | Collins et al. | 315/75 |
| 3,864,598 | 2/1975 | Cardwell, Jr. | 315/74 |
| 3,995,246 | 11/1976 | Morgan | 337/407 |
| 4,398,124 | 8/1983 | Kohl et al. | 315/74 |
| 4,528,479 | 7/1985 | Bonazoli et al. | 315/73 |
| 4,554,526 | 11/1985 | Bricknell | 337/379 |
| 4,581,674 | 4/1986 | Brzozowski | 3671/104 |
| 4,649,320 | 3/1987 | Hough et al. | 315/100 |
| 4,695,768 | 9/1987 | Covington et al. | 315/73 |
| 4,891,551 | 1/1990 | Will et al. | 313/492 |
| 4,978,180 | 12/1990 | Bouchard et al. | 315/73 |
| 5,327,046 | 7/1994 | Ravi et al. | 315/52 |
| 5,345,144 | 9/1994 | Mahonski et al. | 315/71 |
| 5,574,335 | 11/1996 | Sun | 315/119 |
| 5,606,224 | 2/1997 | Hua | 315/121 |

*Primary Examiner*—Leo P. Picard
*Assistant Examiner*—Anatoly Vortman
*Attorney, Agent, or Firm*—Wyatt, Gerber, Meller & O'Rourke

[57] ABSTRACT

A fluorescent lamp thermal fuse arrangement is disclosed. The arrangement in a preferred embodiment comprises a fluorescent glass tube lamp, a thermal fuse wrapped externally around an end of the lamp, electrically insulated mechanical means, lead portions of the thermal fuse and strain relief, and a thermally and electrically insulating protective cover placed over the thermal fuse to concentrate heat around the fuse and to electrically isolate the lamp end from the surrounding environment. The lamp has a maximum normal operating temperature, a coating of emissive material on a cathode of the lamp, a plurality of lamp cathode leads, and a termination electrically connected to a fluorescent lamp power source. The thermal fuse is electrically connected in series between at least one lamp cathode lead and the termination. The protective cover provides electrical insulation to the surrounding environment and a small space for melted fuse material to flow regardless of lamp orientation. A strain relief is preferably provided at a point of exit of the termination from the protective cover. In operation, when the temperature of the lamp end rises above the maximum normal operating temperature of the lamp, the fuse material melts and breaks the electrical circuit to the lamp.

11 Claims, 5 Drawing Sheets

THERMAL FUSE FOR FLUORESCENT LAMPS

BACKGROUND OF THE INVENTION

The present invention relates to fluorescent lamps and more particularly to a fluorescent lamp thermal fuse arrangement for use in environments where detection of excess heat generated by such lamps is important.

DESCRIPTION OF THE RELATED ART

Fluorescent lamps, both cold cathode and hot cathode, operate with a coating of emissive material on the cathodes which readily release electrons for the proper functioning of the lamp. The amount of power (and thus heat) dissipated at the cathodes to achieve this emission is relatively low during normal operation.

Through many hours of operation, the emissive coating will be completely used up, whereupon the power dissipated at the cathode will increase dramatically, causing a rise in temperature in the area of the cathode. High heat generation is a significant safety concern, as well as being a potential initiator of combustion of flammable material in the proximity of the heating lamp end. Given no other event which would cause the lamp to stop operating, the heat generated in this area will increase and will be radiated and conducted to the outside glass wall and to the lamp end. Dependent upon the physical characteristics of the lamp, this heat can reach temperatures above the flash point of some common materials. To preclude the continuation of this high heat condition, a thermal fuse is used to break the electrical circuit to the lamp. The lamp then ceases conducting electricity which results in the cooling of the lamp to the ambient temperature and further operation of the lamp is prevented.

At the present time there are a large variety of thermal switch constructions and arrangements. For example, U.S. Pat. No. 4,891,551 to Will et al. shows one type of thermal fuse arrangement wherein a thermal fuse link is connected internally to a fluorescent lamp between a conductive electrode support and an electrode guard. Excessive heat melts the fuse link and breaks the connection. See also Arendash U.S. Pat. No. 3,737,717 whose sodium mercury vapor lamp includes an internal bimetallic strip. Upon excessive heat rise within the envelope, the strip flexes sharply to short circuit and extinguish the lamp.

Other patents of interest are Morgan U.S. Pat. No. 3,995,246, Sun U.S. Pat. No. 5,574,335, and Hua U.S. Pat. No. 5,606,224.

The Morgan patent mentioned above typifies a fusible composition which on overheating melts and breaks the electrical circuit. The Sun and Hua patents relate to protection circuits for arc discharge or fluorescent lamps approaching the end of their operating life. End-of-life sensing circuity that monitors the operation of small diameter fluorescent lamps and shuts the system down at the end of the lamp life to protect against overheating is also commercially available.

A known arrangement employs a thermal fuse mounted axially as a lead along the side of a fluorescent lamp. However, there is still a need for a thermal fuse arrangement which provides repeatable and consistent results with respect to detection of excess heat and termination of current flow.

OBJECTIVES AND FEATURES OF THE INVENTION

It is an objective of the present invention to provide a fluorescent lamp thermal fuse arrangement which permits detection of excess heat and permanent termination of current flow, so that it may be used, for example, in environments where detection and prevention of excess heat is needed.

It is a further objective of the present invention to provide such an arrangement which may use a thermal fuse formed of inexpensive materials, and yet will provide a reliable safeguard against fluorescent lamp overheating.

It is a further feature of the present invention to provide such an arrangement which may be used with a small diameter fluorescent lamp, for example, a "T3" or "T5" type of fluorescent lamp.

It is a further objective of the present invention to provide such an arrangement which permits ease of assembly of the fuse into the circuit.

It is a further objective of the present invention to provide such an arrangement which permits adjustment of flow and separation characteristics of the fuse material by augmenting it with one or more other materials.

It is a further objective of the present invention to provide such an arrangement that yields significantly more consistent and reproducible results than conventional designs and that increases the lighting system availability in environments where detection of excess heat and termination of current flow is important.

It is a further objective of the present invention to provide such an arrangement which may be used with various types of lamp orientations including horizontal, vertical and oblique orientations of the lamp.

It is a further objective of the present invention to provide such an arrangement which is especially designed for use in both cold cathode and hot cathode fluorescent lamp systems.

It is a feature of the present invention to provide a fluorescent lamp arrangement formed of the fluorescent lamp glass tube, a thermal fuse wrapped externally around an end of the lamp and secured to the lamp glass, and a thermally and electrically insulating protective cover placed over the thermal fuse. The lamp, which may be a cold cathode or a hot cathode fluorescent lamp, has a maximum normal operating temperature, a coating of emissive material on a cathode of the lamp, a plurality of lamp cathode leads, and a termination electrically connected to a fluorescent lamp power source. For example, the termination may be the lead wire provided with the lamp to allow attachment to the powered line. The thermal fuse is electrically connected in series between at least one lamp lead and the termination. The thermal fuse may be a low electrical resistance material whose flow characteristics are augmented with at least one additional material. The fuse may be placed in contact with the lamp glass by mechanical means, for example a ceramic cement or other high temperature material, to prevent movement and separation.

The thermally and electrically insulating protective cover, which may be formed of a high temperature material such as ceramic in the form of a cap, concentrates heat around the fuse and provides electrical insulation to the surrounding environment as well as providing a small space for melted fuse material to flow regardless of lamp orientation. A strain relief may be provided at the point of exit of the termination from the protective cover to prevent flexing of the fuse material inside the protective cover during use.

It is a further feature of the present invention to provide a mechanical means to physically attach at least one of the lamp leads to the thermal fuse, to mold one end of the thermal fuse to the lamp, and to provide a mechanical means to physically attach the other end of the fuse to a termination. Preferably, the mechanical means are pieces of metal or crimps designed to compress and join one or two of the lamp leads and termination together.

SUMMARY OF THE INVENTION

A fluorescent lamp thermal fuse arrangement is provided to enhance detection of excess heat and terminate current flow.

The arrangement preferably has a fluorescent lamp glass tube, such as a cold cathode or hot cathode fluorescent lamp, a thermal fuse wrapped externally around an end of the lamp and secured to the lamp glass, electrical insulation over exposed lamp leads and the electrical termination (but not the thermal fuse), and a thermally and electrically insulating protective cover over the thermal fuse for concentrating heat around the fuse and for insulating the electrical circuitry.

The fluorescent glass tube lamp has a normal maximum operating temperature, a coating of emissive material on a cathode of the lamp, a plurality of lamp cathode leads, preferably two, and a termination, for example a lead wire electrically connected to a fluorescent lamp power source.

The thermal fuse, which may comprise a low electrical resistance material whose flow characteristics are augmented with at least one additional material, is electrically connected, for example physically attached in series between at least one lamp cathode lead and the termination. For example, a mechanical means such as a crimp may physically attach to at least one of the lamp cathode leads and mold one end of the thermal fuse to the lamp. A second mechanical means or crimp may physically attach the other end of the fuse to a termination.

The thermally and electrically insulating protective cover which may be composed of a high temperature material, preferably ceramic, for example an end cap or other enclosure, provides electrical insulation to the surrounding environment and a small space for melted fuse material to flow regardless of orientation.

Additional high temperature, high dielectric, electrical insulation, for example a ceramic cement, is placed over exposed portions of the lamp cathode leads, the physical attachments of the thermal fuse to the lamp cathode leads and to the termination, to prevent electrical arcing which would possibly negate the functionality of the thermal fuse.

A strain relief may be provided at a point of exit of the termination from the protective cover. A mechanical means is provided to prevent movement of the strain relief and termination relative to the protective cover. For example, a ceramic cement or other high temperature material may be used to mechanically hold the termination wire and strain relief in place within the protective cover.

The thermal fuse may be placed in contact with the lamp glass by mechanical means to prevent movement and separation. For example, a ceramic cement may be used to mechanically place the fuse in contact with the glass of a small diameter fluorescent lamp.

BRIEF DESCRIPTION OF THE DRAWINGS

Other objectives and features of the present invention will be apparent from the following description, taken in conjunction with the accompanying drawings. In the drawings:

FIG. 3A shows the lamp end with vacuum tube tip. FIG. 3B shows the lamp end without vacuum tube tip.

FIG. 5B shows the cold cathode partially broken away to show the coating of emissive material on the cathode.

DETAILED DESCRIPTION

The fluorescent lamp fuse arrangement of the present invention preferably consists of a fluorescent lamp glass tube, a thermal fuse, and a thermally and electrically insulating protective cover. The fuse material is preferably Sn Pb Bi (tin, lead, bismuth) solder alloy and offers electrical characteristics, melting characteristics, and optimal flow characteristics. The electrical resistance of the material is low to preclude a significant (and undesirable) voltage drop across its length. The thermal melting point occurs at a desired temperature above the maximum normal operating temperature of the lamp. The maximum normal operating temperature is the sum of the expected temperature rise of the lamp in normal operation plus the maximum ambient temperature of the surrounding thermal environment. The flow characteristics are affected by the cohesiveness of the material; thus, the material is preferably augmented with one or more other materials, for example solder flux, to achieve the desired flow and separation at its melting temperature.

Figure 1:
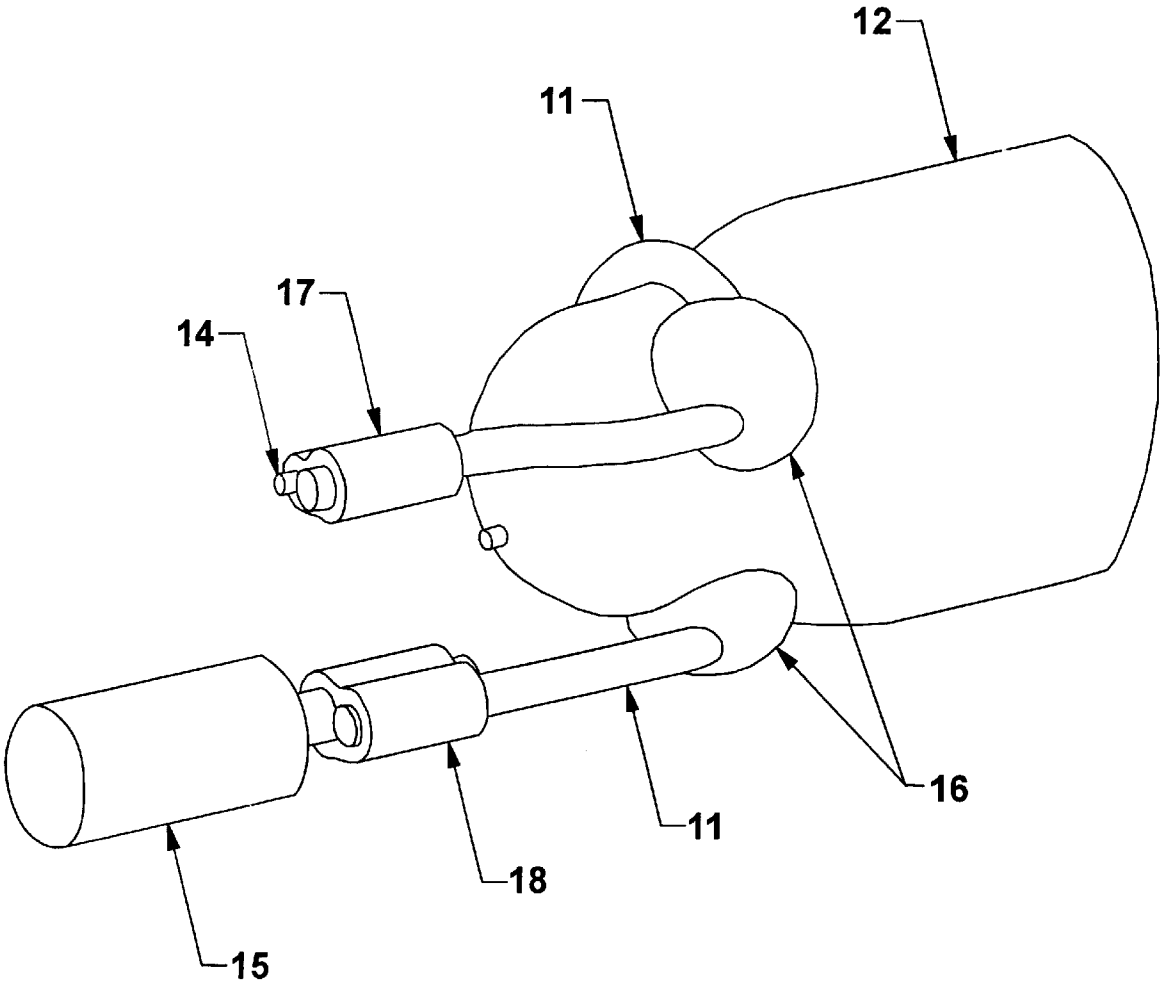
FIG. 1 is a perspective view of a fluorescent glass tube lamp end and attached thermal fuse of an embodiment of the present invention.
Figure 2:
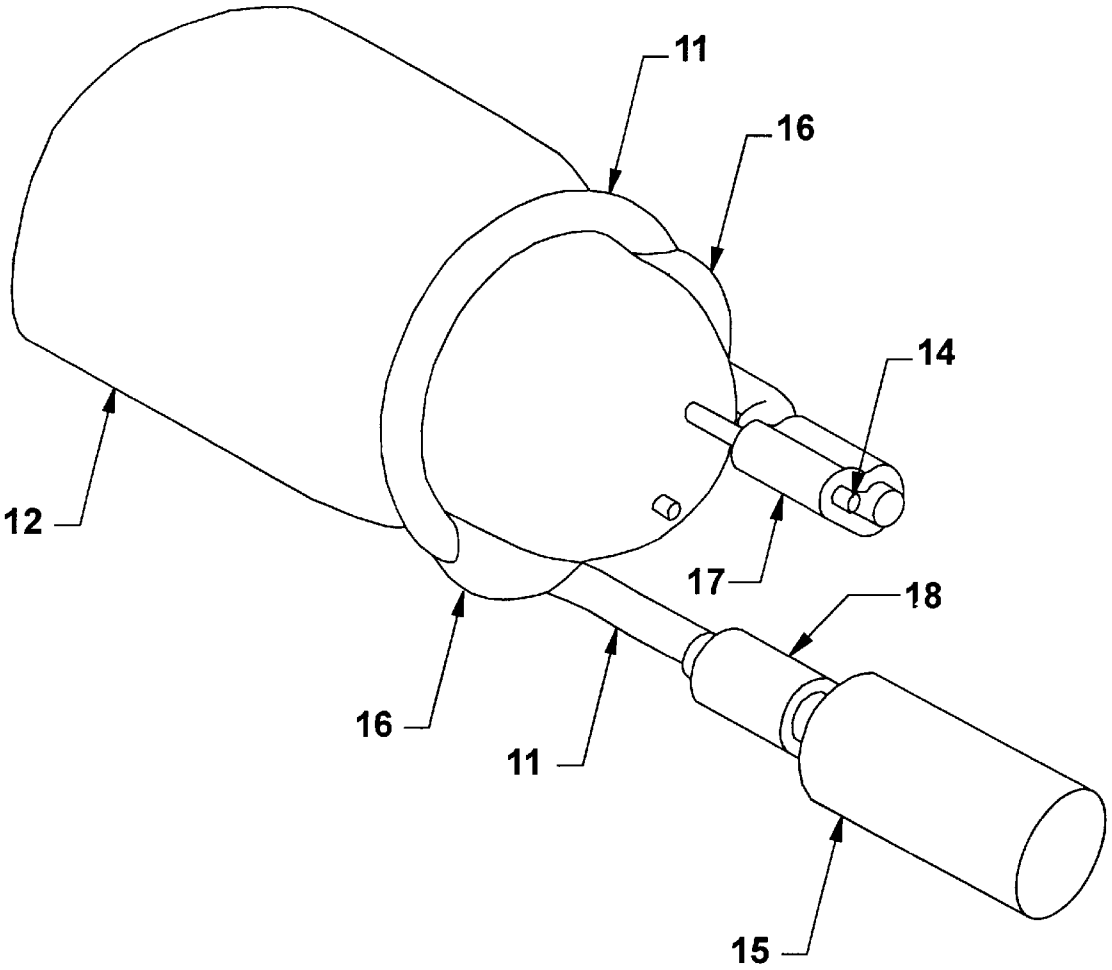
FIG. 2 is an opposing perspective view of the lamp end and fuse of FIG. 1.

The thermal fuse arrangement of a preferred embodiment is shown in FIGS. 1–2 (protective cover not shown for clarity of explanation) and comprises a fluorescent glass tube lamp 12, a thermal fuse 11, and a thermal insulating protective cover 13. (See protective cover 13 in FIGS. 3A and 3B for a preferred embodiment of a protective cover.)

Figure 5A:
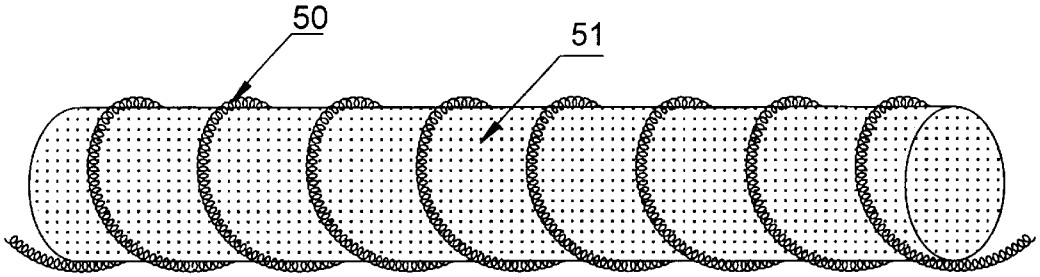
FIGS. 5A and 5B are side views of hot and cold cathodes, respectively, showing emissive material on the cathodes.
Figure 5B:
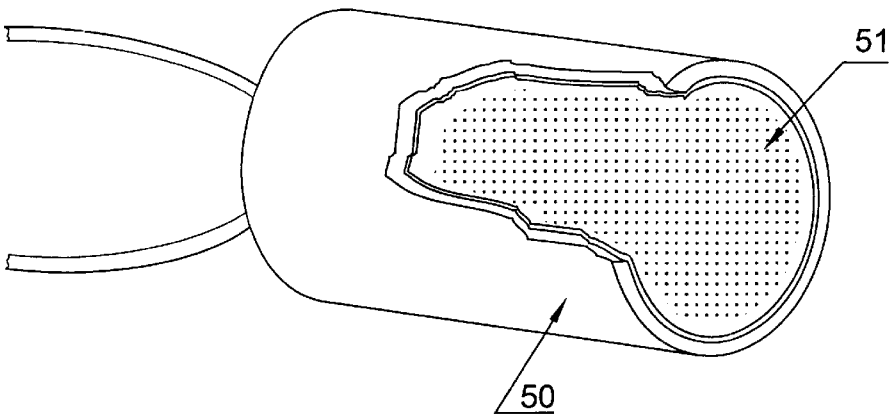

Fluorescent lamp 12 has a maximum operating temperature, a coating of emissive material 51 on a cathode 50 (as shown in FIGS. 5A and 5B) of the lamp, a plurality of lamp cathode leads 14, and a termination 15, for example a lead wire or other termination electrically connected to a fluorescent lamp power source (not shown). Lamp 12 may be either a cold cathode or a hot cathode fluorescent lamp and preferably is a small diameter fluorescent lamp having a diameter less than 0.75 inch, for example a "T5" type fluorescent lamp.

As shown in FIGS. 1 and 2, thermal fuse 11 is wrapped externally around an end of lamp 12 and secured to the lamp glass. The length of fuse 11 may be, for example, 2 inches long. Fuse 11 is electrically connected in series between at least one lamp cathode lead 14 and termination 15, for example physically attached in series between one or both lamp cathode leads 14 and lead wire 15 which is provided with the lamp to allow attachment to a powered line.

Figure 3A:
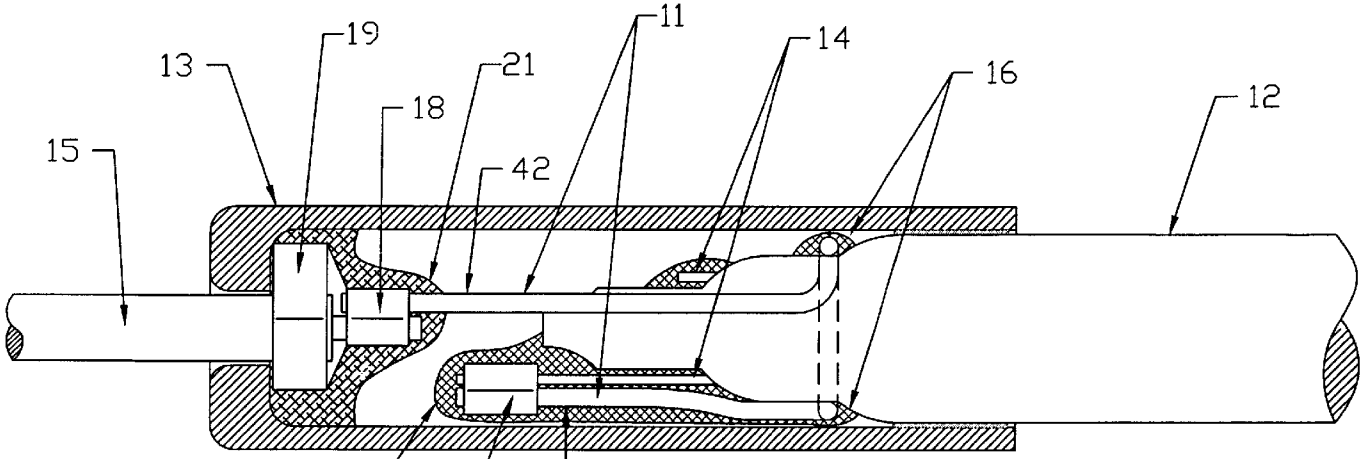
FIGS. 3A and 3B are side elevation views of a thermally and electrically insulating protective cover incorporated in the fluorescent lamp thermal fuse arrangement of the present invention.
Figure 3B:
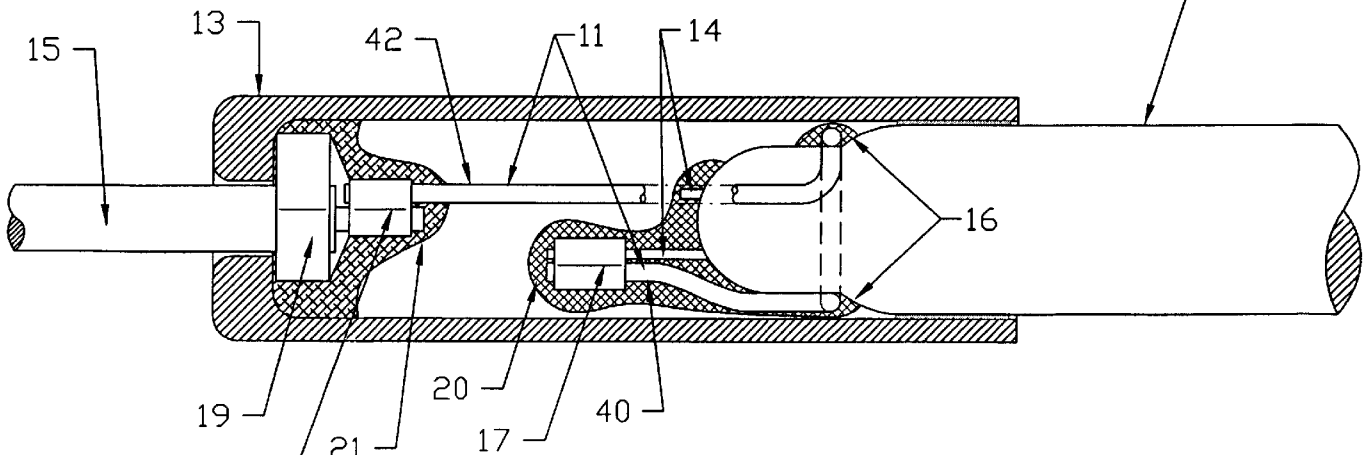

Fuse 11 is placed in intimate contact with the lamp glass and held in place to prevent movement and/or separation from the glass by mechanical means 16, such as a ceramic, silicone or other high temperature cement capable of withstanding temperatures in excess of 600° F. or other mechanical means, for example, baffles integral with the protective cover which would hold the fuse to the glass. For example, a mechanical means 17 may physically attach to at least one of the lamp cathode leads 14 and mold one end of thermal fuse 11 to lamp 12. A second mechanical means 18 may physically attach the other end of fuse 11 to termination 15. First and second mechanical means 17, 18 may comprise a crimp or piece of metal designed to compress one or two of the lamp cathode leads 14 together with fuse 11. Alternatively, a small wire nut may be used to join the items together by pressing and twisting them into a conical housing. As shown in FIGS. 3A and 3B, the exposed lamp cathode leads 14, the mechanical means 17 and the lead portion 40 of fuse 11 between the mechanical means 17 and mechanical means 16 are electrically insulated using a high temperature, high dielectric strength barrier 20, such as ceramic cement to prevent electrical shorting of fuse 11. If desired, the lead portion 42 of fuse 11 between the mechanical means 18 and mechanical means 16 may be electrically insulated as well. The strain relief 19 and the mechanical means 18 are preferably electrically insulated and mechanically held in place using a high temperature, high dielectric strength barrier 21, such as ceramic cement, to prevent movement and to prevent electrical shorting of fuse 11.

The thermal fuse arrangement also comprises a thermally and electrically insulating protective cover, for example end cap 13, as shown in FIGS. 3A and 3B, placed over thermal fuse 11 to concentrate heat around fuse 11 and to provide a small space for the melted fuse material 11 to flow, regardless of lamp orientation, allowing the electrical circuit to be broken.

A protective cover is also used to provide electrical insulation to and shield the electrical connections from the surrounding environment. Preferably the protective cover 13 comprises a high temperature material such as a ceramic or high temperature plastic material selected for its ability to withstand exposure to high heat (for example, over 600° F.) and for its thermal and electrical insulating properties. The protective cover material provides a high insulation barrier to diminish heat at the end of lamp 12 from radiating to its surroundings. The protective cover 13 may comprise a hollow cylinder having a baffle on its inside wall which operates as the mechanical means to press up against fuse 11 and hold it physically against the glass of lamp 12. A strain relief 19 may also be provided at the point of exit of termination of lead wire 15 from the protective cover 13. This strain relief 19 prevents flexing of the fuse material 11 inside the protective cover 13 during use.

Figure 4B:
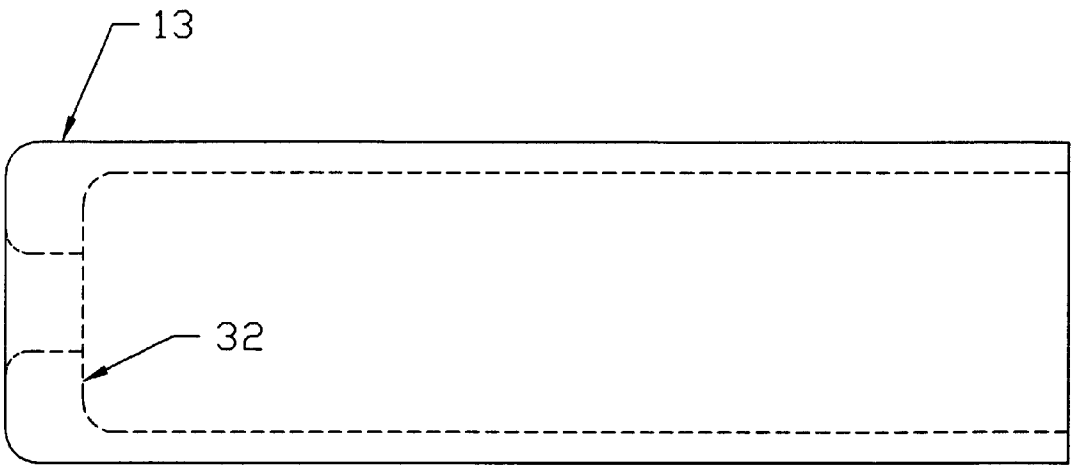
FIGS. 4A and 4B are an end view and a side view, respectively, of a typical ceramic protective cover incorporated in the fluorescent lamp thermal fuse arrangement of the present invention to be used with, for example, an 8 mm diameter fluorescent lamp.
Figure 4A:
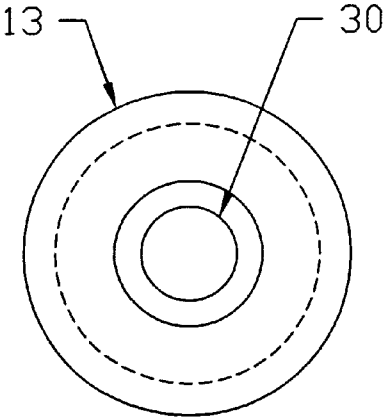

Typical and preferred dimensions of protective cover 13 for an 8 mm lamp end are as follows: overall diameter=0.410±0.010 inch; inside diameter=0.330+0.010, −0.000 inch; Exit hole 30 diameter at closed end=0.120±0.005 inch; chamfer radius around Exit hole 30=0.030+0.015, −0.000 inch; overall length=1.35±0.015 inches; depth of counter bore 32=1.25±0.015 inches. A tool radius is allowed inside and outside at the closed end. An end view and a side view are shown in FIGS. 4A and 4B, respectively. Those skilled in the art will recognize that other dimensions and configurations may be used depending on the particular lamp and needs involved.

In operation, when the temperature of the lamp end begins to rise above its maximum normal operating temperature, the heat within the protective cover 13 rises quickly due to the increased power dissipation within the lamp end. The thermal insulating characteristic of the protective cover 13 acts to contain the heat and to concentrate it on the thermal fuse. Simultaneously, the protective cover 13 shields the immediate surroundings from this heat. The temperature inside the protective cover 13 reaches the melting point of the fuse material, causing fuse 11 to melt and separate. This action breaks the electrical circuit to lamp 12. Lamp 12 cools, and as the temperature falls below the melting point of the fuse material, fuse 11 solidifies and remains in a separated state, preventing future operation of lamp 12.

The fluorescent lamp thermal fuse arrangement offers enhanced detection of excess heat and termination of current flow. By this arrangement, the fuse material is placed in the area in which lamp 12 heats up consistently, and more consistent and repeatable results are obtained.

Having described the invention in detail and by reference to the preferred embodiments thereof, it will be apparent that modifications and variations are possible without departing from the scope of the invention defined in the following claims.

We claim:

1. A fluorescent lamp thermal fuse arrangement comprising:

a. a fluorescent lamp glass tube having a maximum normal operating temperature, a coating of emissive material on a cathode of said lamp, a plurality of lamp cathode leads, and a termination electrically connected to a fluorescent lamp power source;

b. a thermal fuse wrapped externally around an end of said lamp and secured to the lamp glass, said fuse electrically connected in series between at least one lamp cathode lead and the termination; and c. a thermally and electrically insulating protective cover placed over said thermal fuse for concentrating heat around said fuse, said protective cover providing thermal and electrical insulation to the surrounding environment and a small space for melted fuse material to flow regardless of lamp orientation.

2. A fluorescent lamp thermal fuse arrangement as in claim 1 wherein a strain relief is provided at a point of exit of the termination from the protective cover.

3. A fluorescent lamp thermal fuse arrangement as in claim 1 wherein said protective cover comprises a high temperature material.

4. A fluorescent lamp thermal fuse arrangement as in claim 1 wherein said thermal fuse is placed in contact with the lamp glass by mechanical means to prevent movement and separation.

5. A fluorescent lamp thermal fuse arrangement as in claim 1 wherein said thermal fuse is physically attached in series between at least one lamp cathode lead and said termination.

6. A fluorescent lamp thermal fuse arrangement as in claim 1 comprising:

a. a thermal fuse having two ends;

b. a first mechanical means physically attaching to at least one of the lamp cathode leads and molding one end of the thermal fuse to the lamp; and c. a second mechanical means physically attaching the other end of the fuse to the termination.

7. A fluorescent lamp thermal fuse arrangement as in claim 1 wherein said lamp is a cold cathode fluorescent lamp.

8. A fluorescent lamp thermal fuse arrangement as in claim 1 wherein said lamp is a hot cathode fluorescent lamp.

9. A fluorescent lamp thermal fuse arrangement as in claim 1 wherein said thermal fuse comprises a low electrical resistance material whose flow characteristics are augmented with at least one additional material.

10. A fluorescent lamp thermal fuse arrangement as in claim 1 wherein said fluorescent lamp is a small diameter fluorescent lamp.

11. A flurosecent lamp thermal fuse arrangement comprising:

a. a fluorescent lamp glass tube having a maximum normal operating temperature, a coating of emissive material on a cathode of said lamp, a plurality of lamp cathode leads, and a termination electrically connected to a fluorescent lamp power source;

b. a thermal fuse wrapped externally around an end of said lamp and secured to the lamp glass, said fuse having a plurality of lead portions electrically connected in series between at least one lamp cathode lead and the termination;

c. a first mechanical means physically attaching to at least one of the lamp cathode leads and molding one end of the thermal fuse to the lamp;

d. a second mechanical means physically attaching the other end of the fuse to the termination; and e. a strain relief provided at a point of exit of the termination from the protective cover;

wherein the first and second mechanical means, the lead portions of the thermal fuse, and the strain relief are electrically insulated to prevent electrical shorting of the thermal fuse.

* * * * *